US010816926B2

(12) United States Patent
Wakimoto

(10) Patent No.: US 10,816,926 B2
(45) Date of Patent: Oct. 27, 2020

(54) IMAGE FORMING APPARATUS FOR FORMING AN IMAGE ON A SHEET

(71) Applicant: KYOCERA Document Solutions Inc., Osaka (JP)

(72) Inventor: Atsuhiro Wakimoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/420,306

(22) Filed: May 23, 2019

(65) Prior Publication Data

US 2019/0369540 A1 Dec. 5, 2019

(30) Foreign Application Priority Data

May 29, 2018 (JP) ..... 2018-102364

(51) Int. Cl.
*G03G 15/00* (2006.01)

(52) U.S. Cl.
CPC ..... *G03G 15/5062* (2013.01); *G03G 15/6529* (2013.01)

(58) Field of Classification Search
CPC ..... G03G 21/206; G03G 2221/1645; G03G 15/6573
See application file for complete search history.

(56) References Cited

U.S. PATENT DOCUMENTS

2006/0133865 A1* 6/2006 Nakamura ..... G03G 15/6573 399/320
2009/0220271 A1* 9/2009 Aratachi ..... G03G 21/206 399/92

FOREIGN PATENT DOCUMENTS

JP 2013-231798 11/2013

* cited by examiner

*Primary Examiner* — Walter L Lindsay, Jr.
*Assistant Examiner* — Andrew V Do
(74) *Attorney, Agent, or Firm* — Lex IP Meister, PLLC

(57) ABSTRACT

Provided is an image forming apparatus including a conveying device, a detecting member, an image forming unit, a first discharge tray, a fan, and an airflow unit. The conveying device conveys a sheet. The detecting member detects a sheet. The image forming unit forms an image on a sheet. The sheet on which an image has been formed by the image forming unit is discharged to the first discharge tray. The fan sucks the air around the first discharge tray. The airflow unit forms an airflow path through which the air sucked by the fan flows. The detecting member detects the presence or absence of the sheet by switching the posture thereof between a first posture and a second posture. When the posture of the detecting member is switched, the airflow path is changed.

13 Claims, 10 Drawing Sheets

411
411f
51
K
5
51k
11h
151
151
UPPER
REAR
LEFT
RIGHT
FRONT
LOWER

IMAGE FORMING APPARATUS FOR FORMING AN IMAGE ON A SHEET

INCORPORATION BY REFERENCE

This application is based upon, and claims the benefit of priority from, corresponding Japanese Patent Application No. 2018-102364 filed in the Japan Patent Office on May 29, 2018, the entire contents of which are incorporated herein by reference.

BACKGROUND

Field of the Invention

The present disclosure relates to an image forming apparatus.

Description of Related Art

A cooling device has been proposed, which includes a fuser, a fan, a duct, a valve, a solenoid, an arm, and a tension spring.

SUMMARY

An image forming apparatus according to the present disclosure includes a conveying device, a detecting member, an image forming unit, a discharge tray, a fan, and an airflow unit. The conveying device conveys a sheet. The detecting member detects the presence or absence of the sheet. The image forming unit forms an image on the sheet. The sheet on which an image has been formed by the image forming unit is discharged into the discharge tray. The fan sucks the air around the discharge tray. The airflow unit forms an airflow path through which the air sucked by the fan flows. The detecting member detects the presence or absence of the sheet by switching the posture thereof between the first posture and the second posture. When the posture of the detecting member is switched, the airflow path is changed.

DETAILED DESCRIPTION

Figure 1:
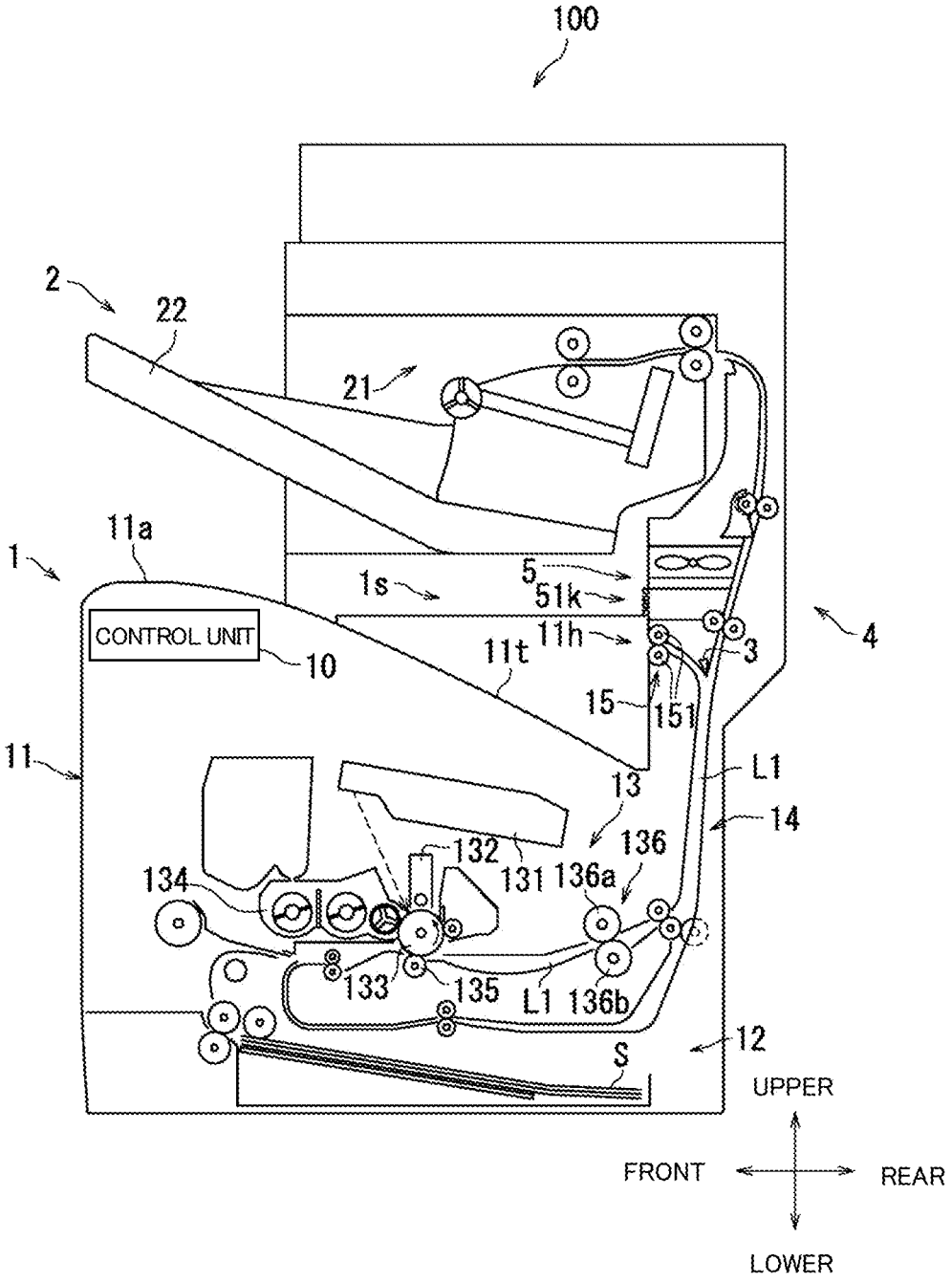
FIG. 1 is a diagram showing a configuration of an image forming apparatus according to an embodiment of the present disclosure.

An embodiment of an image forming apparatus according to the present disclosure is described below with reference to the drawings. In the drawings, the same or corresponding components are attached with the same reference numerals and explanations thereof are not repeated.

First, a configuration of an image forming apparatus 100 according to the present embodiment is described with reference to FIG. 1. FIG. 1 is a diagram showing a configuration of the image forming apparatus 100 according to the present embodiment.

As shown in FIG. 1, the image forming apparatus 100 includes a control unit 10, a printer 1, a finisher 2, a branching member 3, a connecting member 4, and an airflow section 5. According to the present embodiment, the image forming apparatus 100 is a multifunction peripheral in which the finisher 2 is attached to the printer 1. The finisher 2 is an example of an optional device.

In the embodiment described below, the side on which the finisher 2 is disposed is the upper side of the image forming apparatus 100 and the opposite side is the lower side of the image forming apparatus 100. Further, in the embodiment described below, the side on which the connecting member 4 is disposed is the rear side of the image forming apparatus 100 and the opposite side is the front side of the image forming apparatus 100. Moreover, in the embodiment described below, the right side when the image forming apparatus 100 is viewed from the front side is the right side of the image forming apparatus 100 and the opposite side is the left side of the image forming apparatus 100.

The control unit 10 controls the operation of each unit of the image forming apparatus 100. The control unit 10 is configured of a processor such as a central processing unit (CPU). The control unit 10 includes a storage area. The storage area is formed of a semiconductor memory. The semiconductor memory forms, for example, a random access memory (RAM) and a read only memory (ROM). The control unit 10 controls the operation of each unit of the image forming apparatus 100 by executing the control program stored in the storage area.

The printer 1 forms an image on the sheet S. The printer 1 has a configuration provided in a general printer. Specifically, the printer 1 includes a main body chassis 11, a sheet feeding device 12, an image forming unit 13, a first sheet conveying device 14, a discharge unit 15, and a first discharge tray 11*t*. The sheet feeding device 12, the image forming unit 13, the first sheet conveying device 14, and the discharge unit 15 are accommodated inside the main body chassis 11.

The sheet feeding device 12 feeds a plurality of sheets S stored in a cassette one by one. The image forming unit 13 forms an image on the sheet S. According to the present embodiment, the image forming unit 13 forms an image on the sheet S by electrophotography. Specifically, the image forming unit 13 includes an exposure device 131, a charging device 132, a photosensitive drum 133, a developing device 134, a transfer device 135, and a fixing device 136. The exposure device 131 develops the electrostatic latent image on the photosensitive drum 133. The charging device 132 charges the photosensitive drum 133 to a specific potential. The developing device 134 supplies a toner to the photosensitive drum 133 to form a toner image. The fixing device 136 includes a heating member 136*a* and a pressing member 136*b*. The heating member 136*a* and the pressing member 136*b* fix the toner image onto the sheet S by heating and pressing the sheet S.

The first sheet conveying device 14 conveys the sheet S fed from the sheet feeding device 12 to the branching member 3 via the image forming unit 13. The first sheet conveying device 14 includes a plurality of rollers and a guide member, and they constitute a first sheet conveyance path L1. The upstream end of the first sheet conveyance path L1 is connected to the sheet feeding device 12. The downstream end of the first sheet conveyance path L1 is connected to the discharge unit 15 and the connecting member 4.

The discharge unit 15 has a pair of discharge rollers 151. The pair of discharge rollers 151 discharges the sheet S conveyed from the image forming unit 13 by the first sheet conveying device 14 to the first discharge tray 11*t*. The sheet S is discharged to the first discharge tray 11*t* through a sheet discharge port 11*h*. The first discharge tray 11*t* is formed on an upper surface 11*a* of the main body chassis 11. The sheet discharge port 11*h* is formed at a position facing the first discharge tray 11*t* of the main body chassis 11.

The finisher 2 performs optional processing on the sheet S. The optional processing is, for example, punching processing, stapling processing, and alignment processing.

The finisher 2 is disposed above the main body chassis 11. Specifically, the finisher 2 is disposed to form a space with the printer 1. Hereinafter, the space between the printer 1 and the finisher 2 is referred to as "in-body space is". The lower surface of the in-body space is is formed by the first discharge tray 11*t*.

The finisher 2 includes a processing unit 21 and a second discharge tray 22. The processing unit 21 includes, for example, a puncher, a processing tray, and a stapler. The puncher performs a punching process on the sheet S. The stapler executes stapling processing on a plurality of sheets S (sheet bundle) stacked on the processing tray. The sheet S on which the optional processing has been performed is discharged to the second discharge tray 22.

The branching member 3 is disposed at the downstream end of the first sheet conveyance path L1. The branching member 3 is rotatable. The delivery destination of the sheet S is switched between the discharge unit 15 and the connecting member 4 in accordance with the rotation of the branching member 3.

The connecting member 4 connects the printer 1 and the finisher 2.

Figure 2:
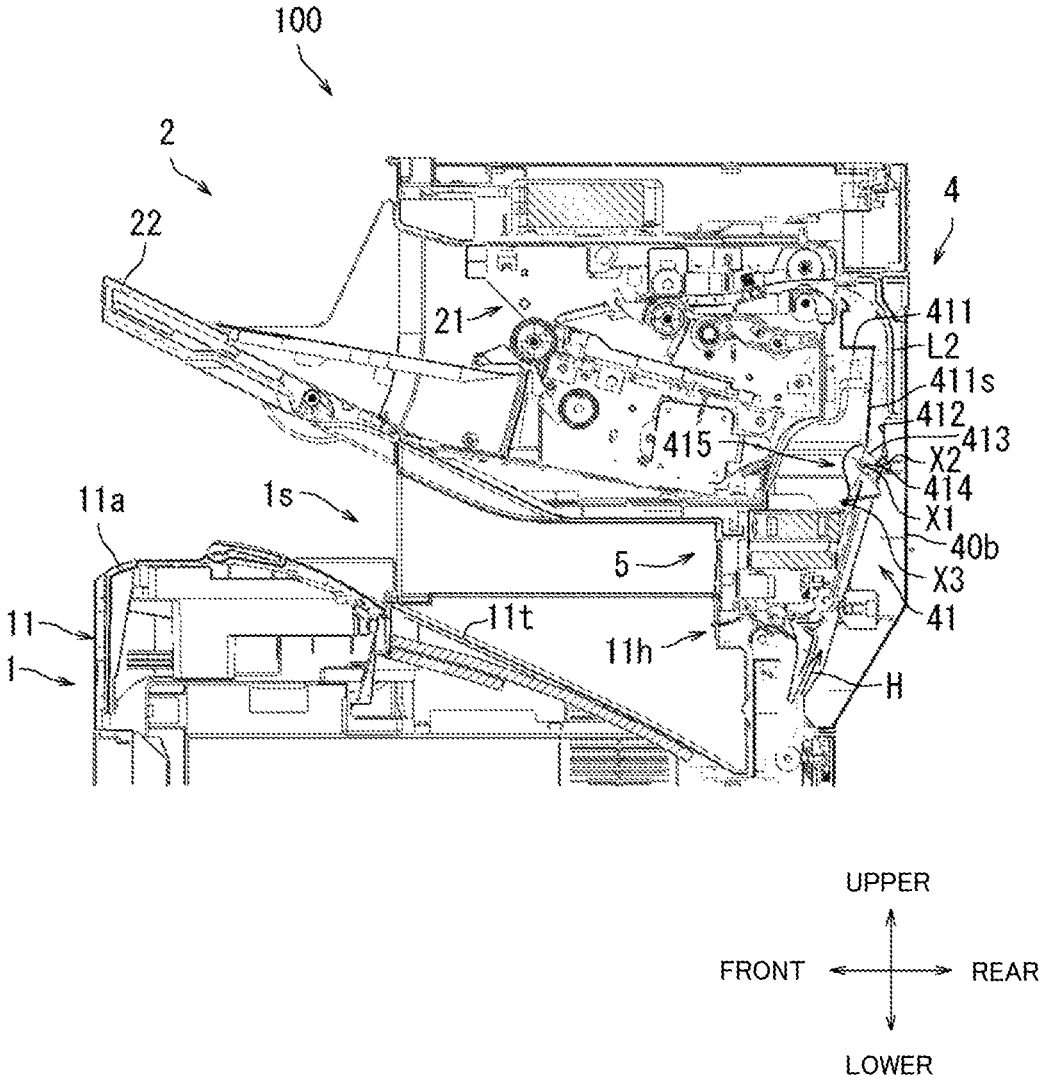
FIG. 2 is a diagram showing a connecting member and the neighborhood thereof according to the embodiment of the present disclosure.
Figure 3:
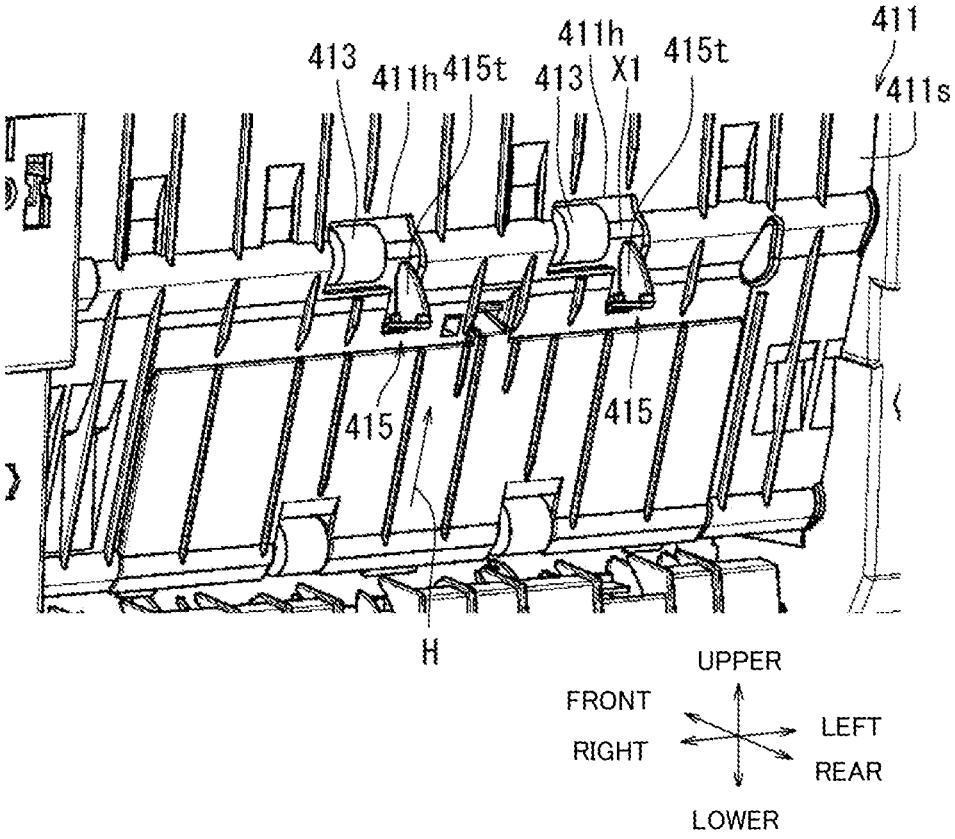
FIG. 3 is a diagram showing a first guide member and a sheet detecting member according to the embodiment of the present disclosure.

Next, with reference to FIGS. 1 to 3, the connecting member 4 according to the present embodiment is described. FIG. 2 is a diagram showing the connecting member 4 according to the present embodiment and the neighborhood thereof.

As shown in FIG. 2, the connecting member 4 includes a rear wall 40*b* and a second sheet conveying device 41. The second sheet conveying device 41 is an example of a conveying device.

The second sheet conveying device 41 conveys the sheet S conveyed from the first sheet conveying device 14 described with reference to FIG. 1 to the finisher 2. Hereinafter, the direction in which the sheet S is conveyed is referred to as "conveying direction H".

The second sheet conveying device 41 includes a first guide member 411, a second guide member 412, a first conveyance roller 413, a second conveyance roller 414, and a sheet detecting member 415. According to the present embodiment, the second sheet conveying device 41 includes the two first conveyance rollers 413, the two second conveyance rollers 414, and the two sheet detecting members 415. The sheet detecting member 415 is an example of a detecting member.

The first guide member 411 and the second guide member 412 guide the sheet S during conveying. The first guide member 411 and the second guide member 412 are disposed to face each other to constitute a second sheet conveyance path L2. The upstream end of the second sheet conveyance path L2 is connected to the downstream end of the first sheet conveyance path L1 described with reference to FIG. 1. The downstream end of the second sheet conveyance path L2 is connected to the finisher 2. Therefore, according to the present embodiment, the sheet S conveyed to the second sheet conveyance path L2 is discharged to the second discharge tray 22 of the finisher 2.

The first guide member 411 includes a guide surface 411*s*. The guide surface 411*s* faces the second guide member 412 to guide the sheet S during conveying. The guide surface 411*s* faces one of the two main surfaces of the sheet S. The main surface of the sheet S indicates the surface on which an image may be formed by the image forming unit 13 among the surfaces of the sheet S. According to the present embodiment, the first guide member 411 is formed of a synthetic resin.

Each of the two first conveyance rollers 413 is disposed to face the corresponding second conveyance roller 414. Specifically, one of the two first conveyance rollers 413 is disposed to face the corresponding one of the two second conveyance rollers 414. The other one of the first conveyance rollers 413 is disposed to face the other one of the second conveyance rollers 414.

Each of the first conveyance rollers 413 is disposed on the side of the first guide member 411. Each of the first conveyance rollers 413 is rotatable around a first rotation shaft X1.

Each of the second conveyance rollers 414 is disposed on the side of the second guide member 412. Each of the second conveyance rollers 414 is rotatable around a second rotation shaft X2. According to the present embodiment, the second conveyance roller 414 rotates in response to the rotation of the first conveyance roller 413.

The sheet S is conveyed in the conveying direction H in accordance with the rotation of each of the first conveyance rollers 413 and each of the second conveyance rollers 414.

Each of the sheet detecting members 415 detects the presence or absence of the sheet S. According to the present embodiment, each of the sheet detecting members 415 detects the presence or absence of the sheet S by switching the posture thereof between the first posture and the second posture. Specifically, each of the sheet detecting members 415 has a third rotation shaft X3 and is rotatable around the third rotation shaft X3.

Each of the sheet detecting members 415 is biased by an elastic member so as to be set in the first posture. The elastic member is, for example, a spring.

Each of the sheet detecting members 415 rotates around the third rotation shaft X3 against the biasing force of the elastic member when the sheet S is brought into contact with it. As a result, the posture of each of the sheet detecting members 415 is switched from the first posture to the second posture. When the posture of each of the sheet detecting members 415 is set in the second posture, a signal indicating that the sheet S has been detected is transmitted to the control unit 10. Each of the sheet detecting members 415 is, for example, an actuator.

FIG. 3 is a diagram showing the first guide member 411 and the sheet detecting member 415 according to the present embodiment. Specifically, FIG. 3 shows the first guide member 411 as viewed from the side of the second guide member 412 (see FIG. 2).

As shown in FIG. 3, the first guide member 411 has two openings 411*h*. The two openings 411*h* are disposed along the left and right direction. In other words, the two openings 411*h* are provided along the direction intersecting the conveying direction H.

Parts of the two first conveyance rollers 413 are exposed through the respective openings 411*h*.

Parts of the two sheet detecting members 415 are exposed through the respective openings 411*h*. Specifically, each of the sheet detecting members 415 includes a protrusion 415*t*. Each of the protrusions 415*t* protrudes to the second sheet conveyance path L2 (see FIG. 2) through the respective opening 411*h*.

Figure 4:
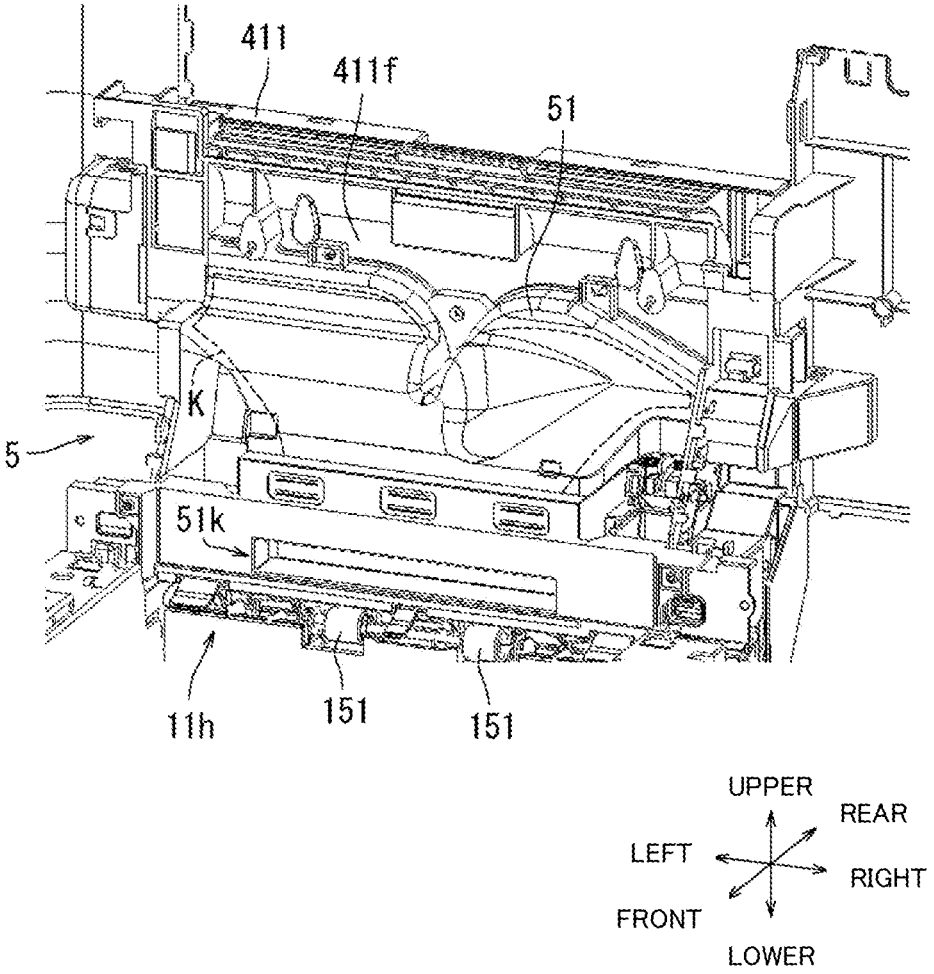
FIG. 4 is a diagram showing a configuration of an airflow section according to the embodiment of the present disclosure.

Next, the configuration of the airflow section 5 according to the present embodiment is described with reference to FIGS. 4 to 6. FIG. 4 is a diagram showing the configuration of the airflow section 5 according to the present embodiment. Specifically, FIG. 4 is a diagram when the first guide member 411 shown in FIG. 2 and the neighborhood thereof are viewed from the front side. In FIG. 4, for easy understanding, the finisher 2 is omitted.

As shown in FIG. 4, the airflow section 5 includes a duct member 51. The duct member 51 is an example of an airflow unit. A suction port 51*k* is formed under the duct member 51.

The duct member 51 is attached to a front wall 411*f* of the first guide member 411 with a fastening member such as a screw. The duct member 51 forms an airflow space K together with the front wall 411*f* of the first guide member 411 by being attached to the front wall 411*f* of the first guide member 411.

Figure 5:
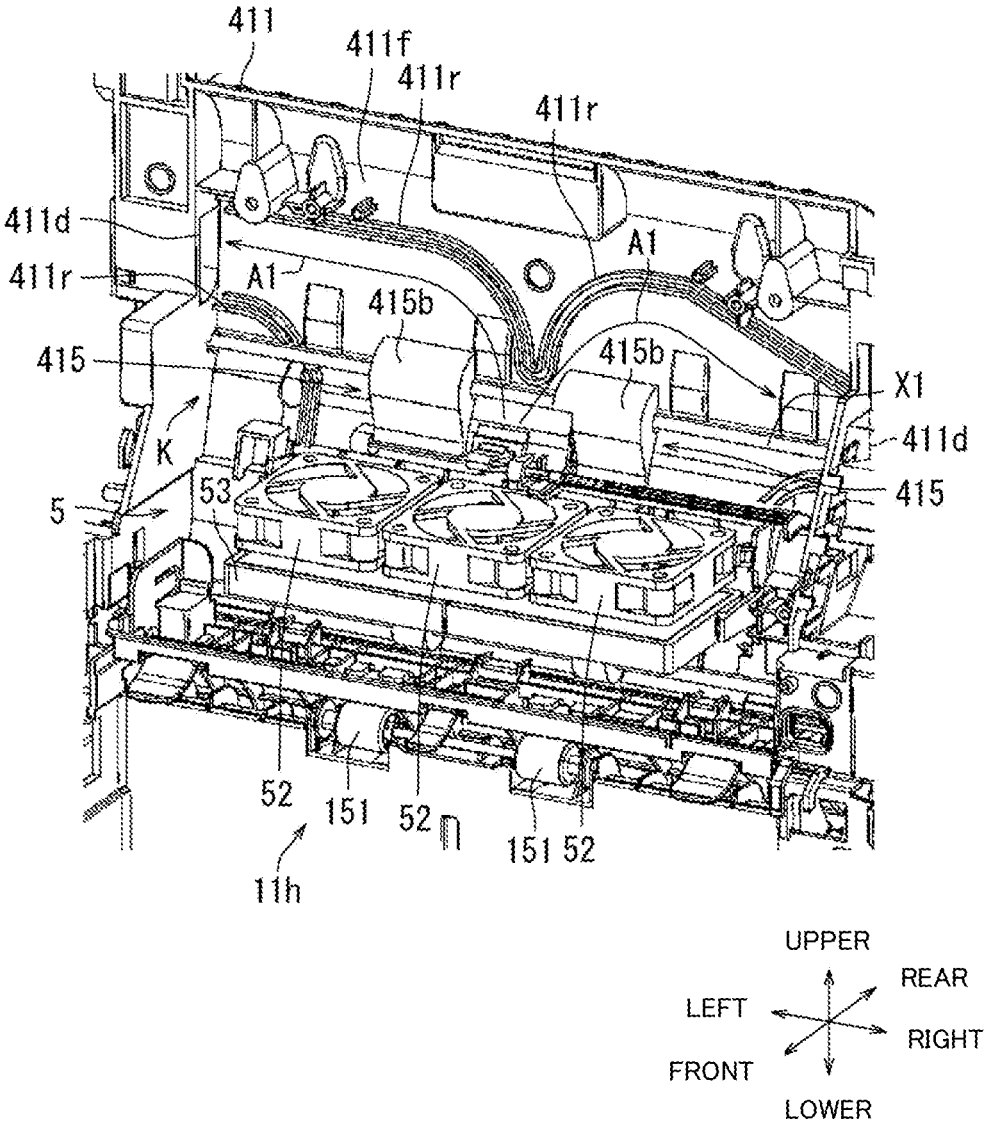
FIG. 5 is a diagram showing a configuration of the airflow section according to the embodiment of the present disclosure.
Figure 6:
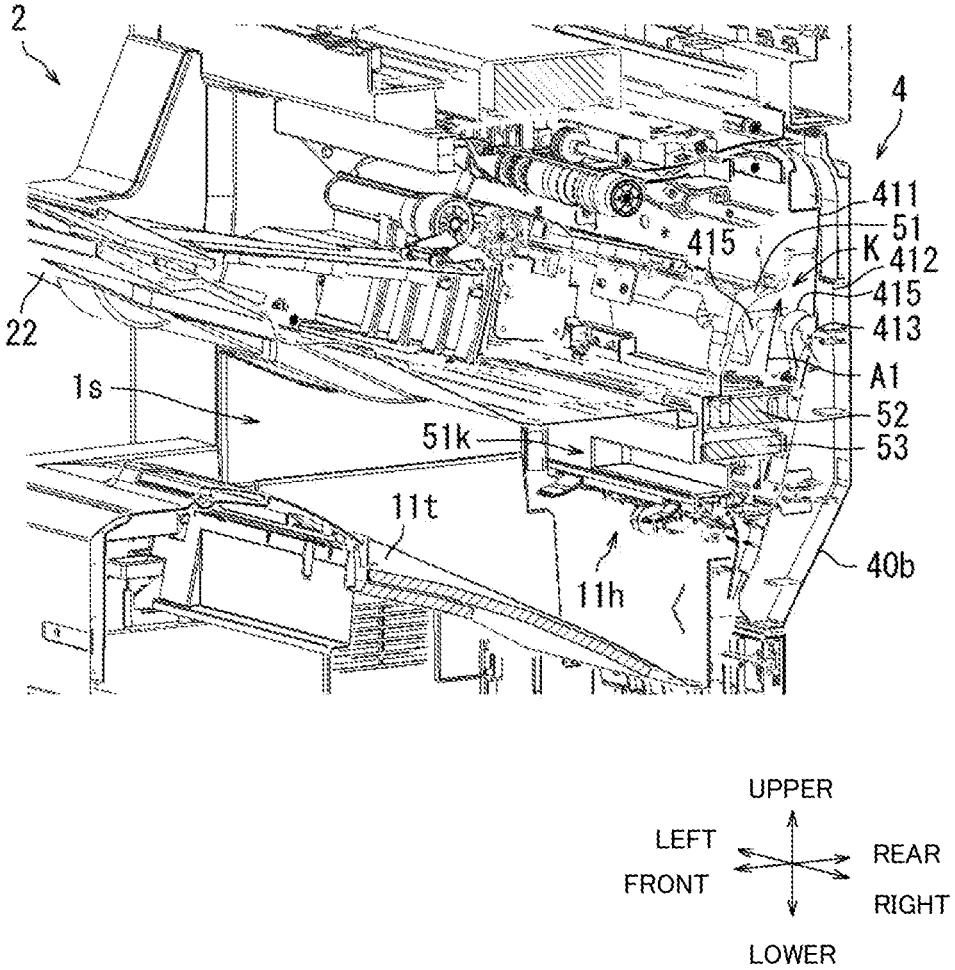
FIG. 6 is a diagram showing a configuration of the airflow section according to the embodiment of the present disclosure.

FIG. 5 and FIG. 6 are diagrams showing the structure of the airflow section 5 according to the present embodiment. Specifically, FIG. 5 shows a state in which the duct member 51 shown in FIG. 4 is removed. FIG. 6 is a perspective view showing the cross section showing the airflow section 5 and the neighborhood thereof. The posture of the sheet detecting member 415 shown in FIGS. 5 and 6 is a first posture.

As shown in FIG. 5, two duct exhaust ports 411*d* are formed in the first guide member 411. The two duct exhaust ports 411*d* are opposed to each other in the left-right direction. The number of the duct exhaust ports 411*d* is not limited to two and may be one or three or more.

The first guide member 411 includes a plurality of ribs 411*r*. The ribs 411*r* are provided on the front wall 411*f* of the first guide member 411. The ribs 411*r* are projected forward from the front wall 411*f*.

The airflow section 5 includes three suction fans 52. The three suction fans 52 are disposed between the duct member 51 and the first guide member 411, described with reference to FIG. 4.

As shown in FIG. 6, each of the suction fans 52 sucks air through the suction port 51*k* by being driven. The suction port 51*k* is formed at a position facing the in-body space 1*s*. Therefore, each of the suction fans 52 sucks the air in the in-body space 1*s* by being driven. In other words, each of the suction fans 52 sucks air around the first discharge tray 11*t* by being driven.

A filter 53 is disposed between the suction port 51*k* and the suction fan 52 in the airflow space K. The filter 53 removes foreign substances such as fine particles contained in the air sucked through the suction port 51*k*. Thus, the odor generated due to the sheet S discharged to the first discharge tray 11*t* may be collected. The odor generated due to the sheet S is generated, for example, when the toner is fixed to the sheet S.

The air sucked through the suction port 51*k* flows in the airflow space K along an arrow A1. Hereinafter, when the posture of the sheet detecting member 415 is the first posture, a path through which the air sucked through the suction port 51*k* flows is referred to as a "first airflow path". The air sucked through the suction port 51*k* flows to the duct exhaust port 411*d* (see FIG. 5) along the ribs 411*r*.

Figure 7:
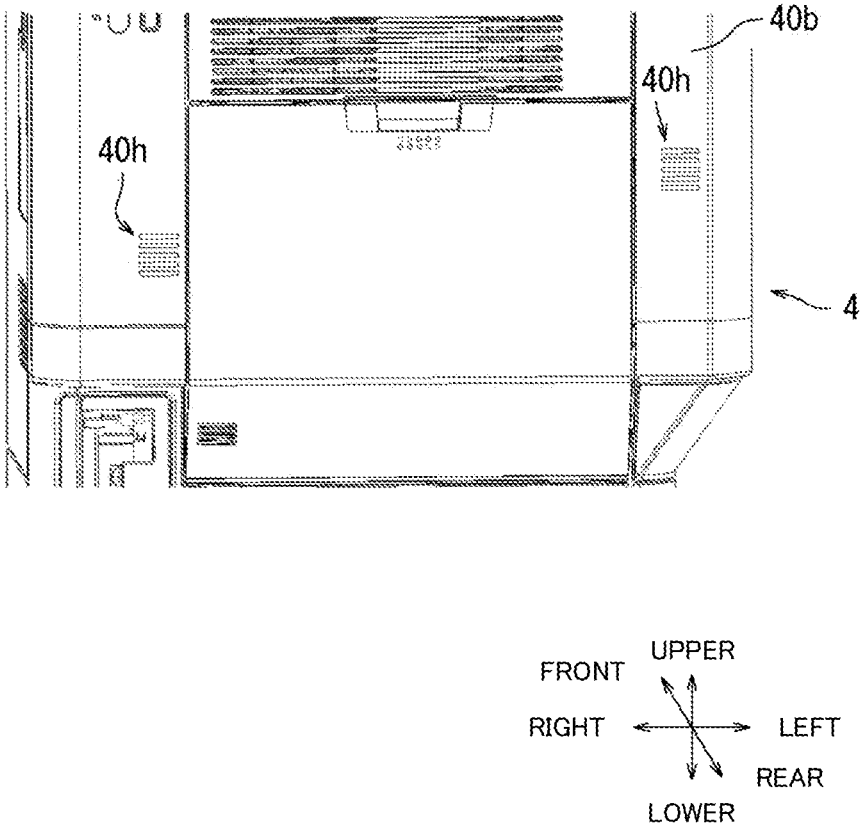
FIG. 7 is a diagram showing a configuration of the connecting member according to the embodiment of the present disclosure.

Next, the configuration of the connecting member 4 according to the present embodiment is described with reference to FIGS. 5 and 7. FIG. 7 is a diagram showing the configuration of the connecting member 4 according to the present embodiment. Specifically, FIG. 7 is a diagram when the connecting member 4 described with reference to FIG. 2 is viewed from the rear side.

As shown in FIG. 7, two external exhaust ports 40*h* are formed in the rear wall 40*b* of the connecting member 4. The air having flowed to each of the duct exhaust ports 411*d* (see FIG. 5) is exhausted to the outside of the apparatus through the corresponding external exhaust port 40*h*. Specifically, out of the two duct exhaust ports 411*d*, the air having flowed to the duct exhaust port 411*d* on the left side of the image forming apparatus 100 is exhausted to the outside through the external exhaust port 40*h* on the left side of the image forming apparatus 100, and the air having flowed to the duct exhaust port 411*d* on the right side of the image forming apparatus 100 is exhausted to the outside through the external exhaust port 40*h* on the right side of the image forming apparatus 100.

Figure 8:
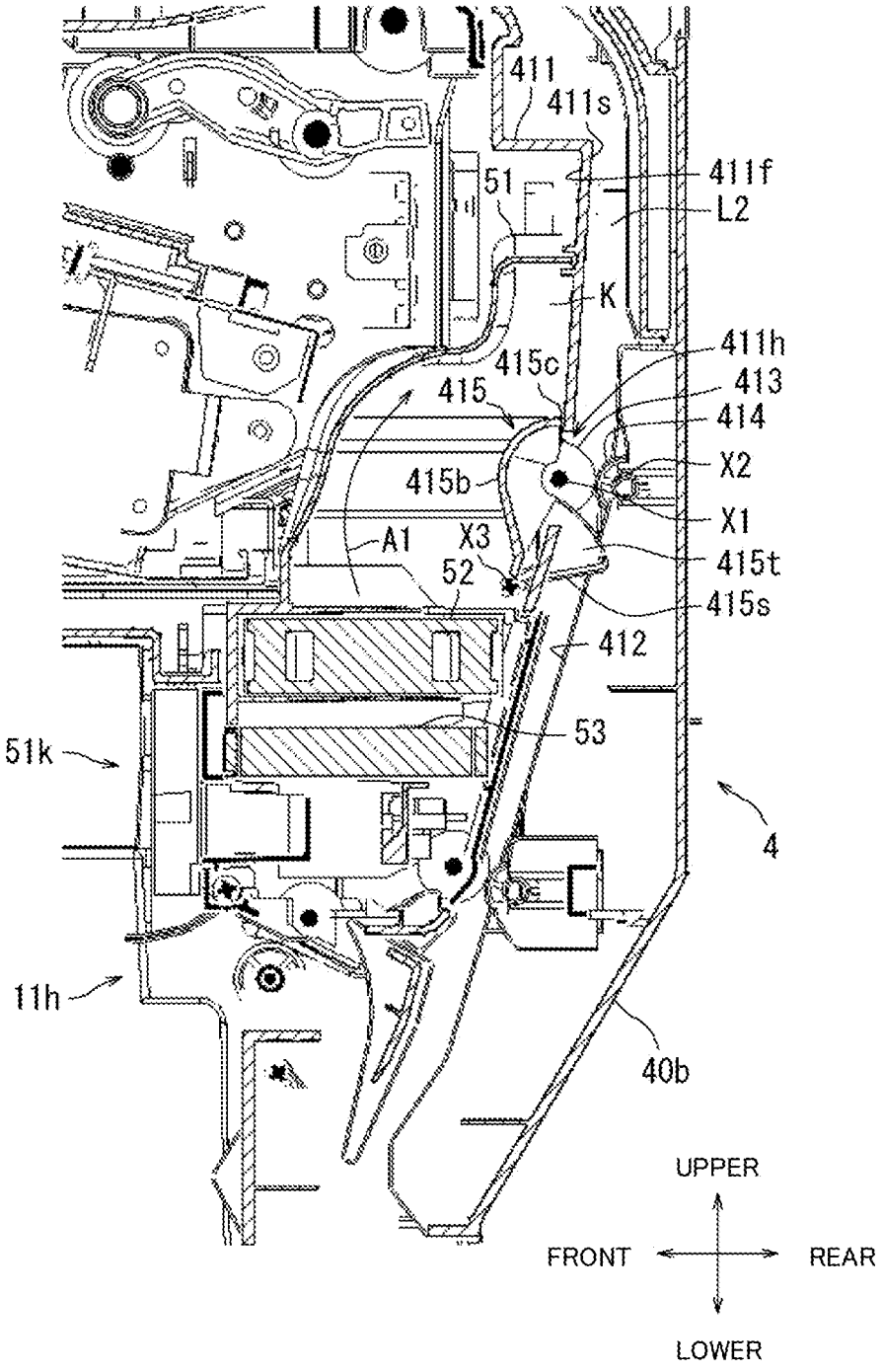
FIG. 8 is a diagram showing a sheet detecting member and the neighborhood thereof according to the embodiment of the present disclosure.
Figure 9:
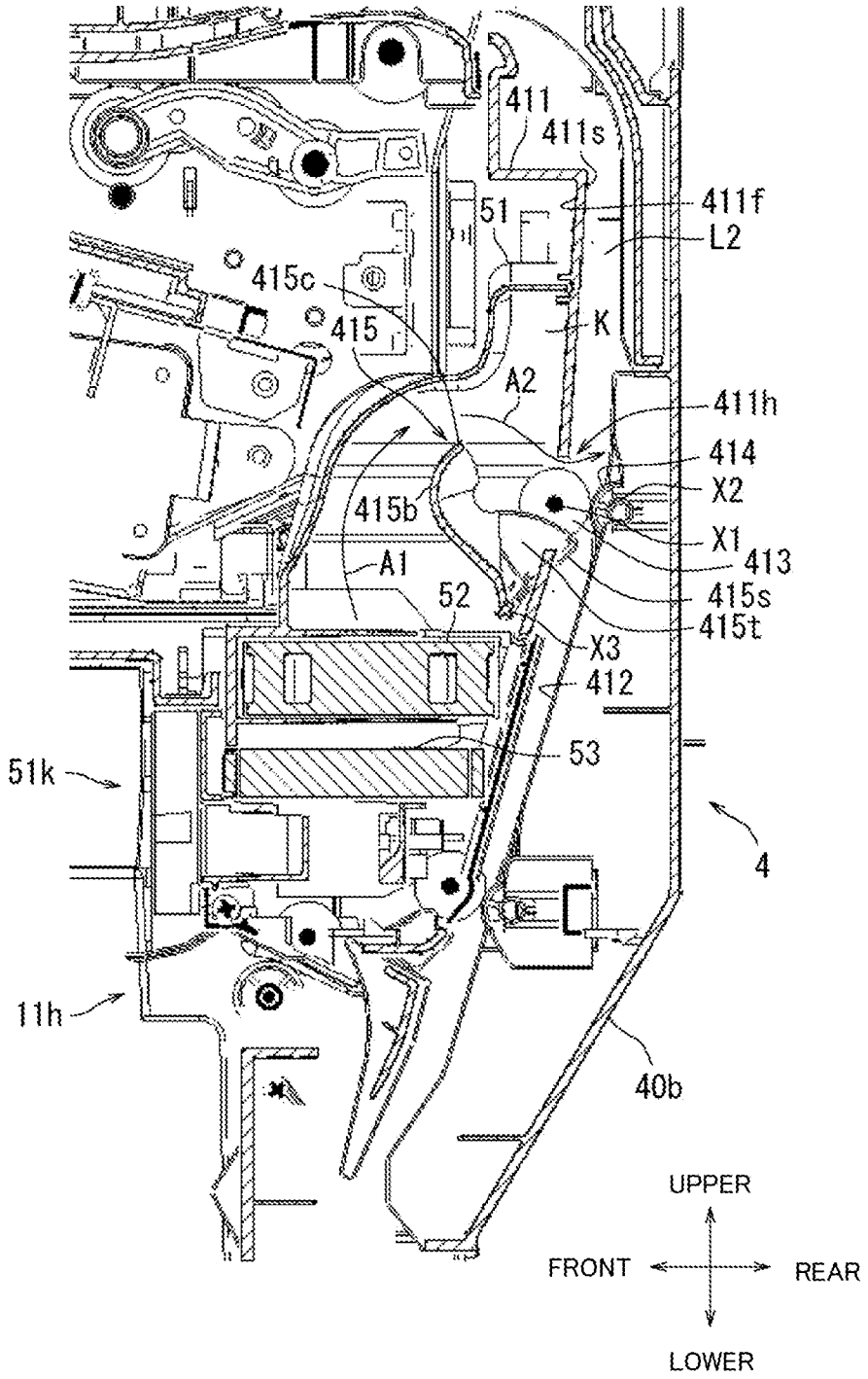
FIG. 9 is a diagram showing the sheet detecting member and the neighborhood thereof according to the embodiment of the present disclosure.
Figure 10:
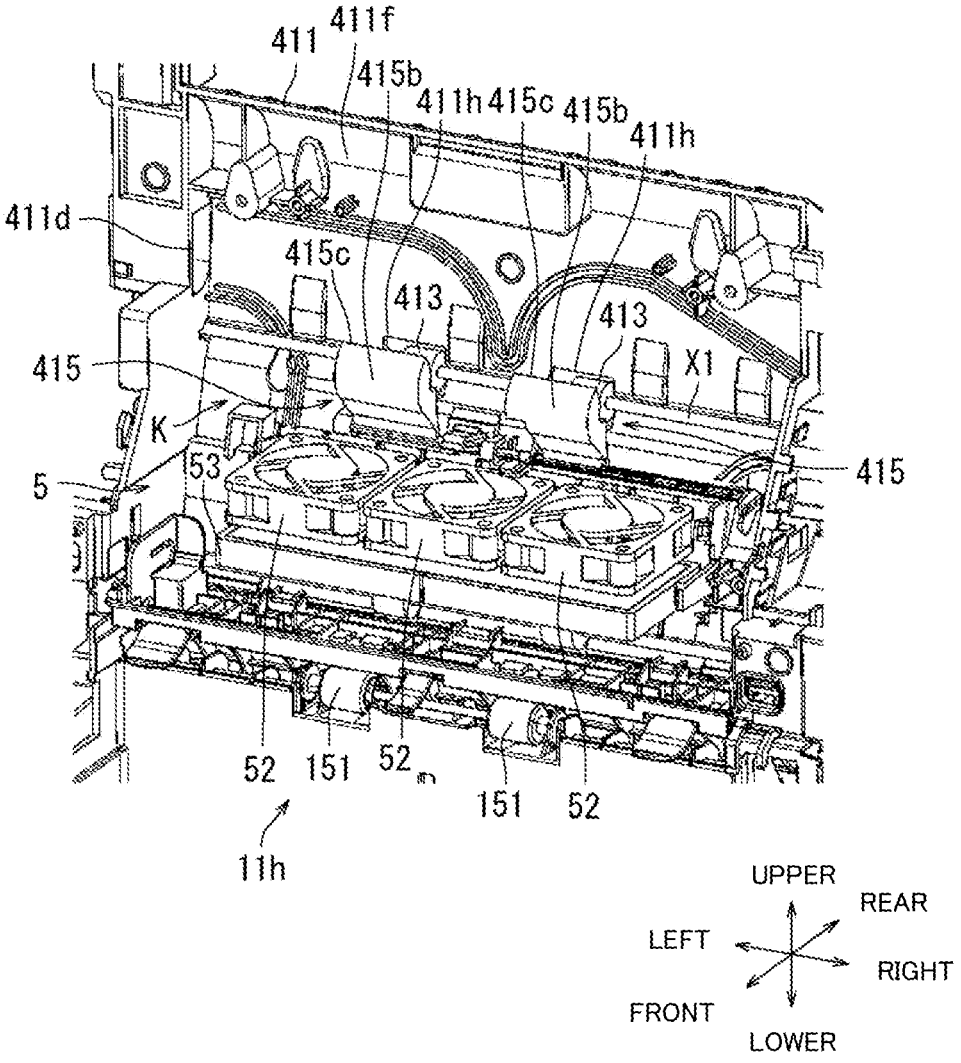
FIG. 10 is a diagram showing a configuration of the airflow section according to the embodiment of the present disclosure.

Next, the sheet detecting member 415 according to the present embodiment is described with reference to FIG. 5 and FIGS. 8 to 10. FIGS. 8 and 9 are diagrams showing the sheet detecting member 415 according to the present embodiment and the neighborhood thereof. Specifically, FIG. 8 shows the sheet detecting member 415 in the first posture, and FIG. 9 shows the sheet detecting member 415 in the second posture. FIG. 10 is a diagram showing the configuration of the airflow section 5 according to the present embodiment. Specifically, FIG. 10 shows the airflow section 5 in the case where the posture of the sheet detecting member 415 is the second posture.

As shown in FIG. 8, the sheet detecting member 415 includes an airflow valve part 415*b* in addition to the protrusion 415*t*.

The airflow valve part 415*b* has a shape corresponding to the part of the first conveyance roller 413 that is not exposed from the first guide member 411. Specifically, the shape of the airflow valve part 415*b* when viewed from the side is the arc shape with the first rotation shaft X1 as a center. The airflow valve part 415*b* covers part of the first conveyance roller 413 from the first rotation shaft X1 to the outer circumference of the first conveyance roller 413 when the sheet detecting member 415 is in the first posture.

The airflow valve part 415*b* covers the opening 411*h* when the sheet detecting member 415 is in the first posture. Specifically, the airflow valve part 415*b* includes a lid part 415*c*. The lid part 415*c* is in contact with the front wall 411*f* of the first guide member 411 to cover the opening 411*h* when the sheet detecting member 415 is in the first posture. Therefore, the second sheet conveyance path L2 and the airflow space K are disconnected.

According to the present embodiment, the lid part 415*c* includes an adhesive member. The adhesive member is formed of an elastic member such as rubber and sponge. The lid part 415*c* includes the adhesive member so that the sheet detecting member 415 and the first guide member 411 adhere to each other. As a result, it is ensured that the second sheet conveyance path L2 and the airflow space K are disconnected.

The protrusion 415*t* has a contact surface 415*s*. The contact surface 415*s* intersects the second sheet conveyance path L2 when the posture of the sheet detecting member 415 is the first posture. According to the present embodiment, the contact surface 415*s* extends across the second sheet conveyance path L2 when the posture of the sheet detecting member 415 is the first posture. Therefore, the sheet S is brought into contact with the contact surface 415*s* when being conveyed through the second sheet conveyance path L2. When the sheet S is brought into contact with the contact surface 415*s*, the airflow valve part 415*b* and the protrusion 415*t* rotate together. As a result, as shown in FIG. 9, the posture of the sheet detecting member 415 is switched from the first posture to the second posture.

When the posture of the sheet detecting member 415 is set in the second posture, the opening 411*h* is opened. Specifically, when the posture of the sheet detecting member 415 is the second posture, the airflow space K communicates with the second sheet conveyance path L2 through the opening 411*h*. Thus, part of the air flowing along the arrow A1 flows into the second sheet conveyance path L2 through the opening 411*h* as indicated by an arrow A2. Hereinafter, a path through which air flows when the sheet detecting member 415 is in the second posture (when the opening 411*h* is opened) is referred to as a "second airflow path". The opening 411*h* forms the second airflow path.

The sheet S heated by the heating member 136*a* described with reference to FIG. 1 is conveyed to the second sheet conveyance path L2. Therefore, the air flows into the second sheet conveyance path L2 through the opening 411*h*, whereby the heated sheet S is cooled. As a result, an increase in the temperature of the finisher 2 may be suppressed.

Further, a curl of the sheet S may be suppressed by cooling the heated sheet S. As a result, for example, interference of the optional processing on the sheet S is suppressed.

The embodiment of the present disclosure has been described above. The typical image forming apparatus 100 includes the sheet detecting member 415 that detects the sheet S. According to the present embodiment, when the posture is switched, the sheet detecting member 415 changes the airflow path as well as detecting the sheet S. Therefore, the image forming apparatus 100 does not need to be provided with a separate member for changing the airflow path. Thus, the airflow path may be changed without increasing the number of parts.

Further, according to the present embodiment, the sheet detecting member 415 switches its posture when the sheet S is brought into contact with the contact surface 415*s*. The airflow valve part 415*b* covers the opening 411*h* and blocks the second airflow path when the sheet detecting member 415 is in the first posture. On the other hand, when the sheet detecting member 415 is in the second posture, the airflow valve part 415*b* opens the opening 411*h* and opens the second airflow path. Therefore, the airflow path may be changed without the need for electrical control.

Further, according to the present embodiment, the second sheet conveying device 41 has the plurality (two) of sheet detecting members 415. Therefore, the control unit 10 is capable of detecting, for example, the size of the sheet S based on the signal output from each of the sheet detecting members 415.

Further, as the second sheet conveying device 41 includes the plurality (two) of the sheet detecting members 415, the control unit 10 is capable of detecting, for example, skew of the sheet S based on the signal output from each of the sheet detecting members 415.

Although the number of the first conveyance rollers 413 and the number of the second conveyance rollers 414 are two in the case explained according to the present embodiment, the number of the first conveyance rollers 413 and the number of the second conveyance rollers 414 may be one or three or more.

Furthermore, although the number of the suction fans 52 is three in the configuration explained according to the present embodiment, the number of the suction fans 52 may be one or two or four or more.

Further, although the number of the openings 411*h* and the number of the sheet detecting members 415 is two in the configuration explained according to the present embodiment, the number of the openings 411*h* and the number of the sheet detecting members 415 is not limited to two. The number of the openings 411*h* and the number of the sheet detecting members 415 may be one or three or more. The number of the sheet detecting members 415 is changed according to the number of the openings 411*h*.

The embodiment of the present disclosure is explained above with reference to the drawings (FIGS. 1-10). However, the present disclosure is not limited to the above-described embodiment and may be implemented in various forms without departing from the scope of the present disclosure. Furthermore, the configuration described in the above embodiment is an example and is not particularly a limitation, and various changes may be made without substantially departing from the advantage of the present disclosure.

For example, in the case explained according to the embodiment of the present disclosure, the present disclosure is applied to the image forming apparatus 100 to which the optional device such as the finisher 2 is attached; however, the present disclosure is applicable to an image forming apparatus to which no optional device is attached. In this case, the image forming apparatus further includes a discharge tray different from the first discharge tray, and the sheet S to be discharged to the discharge tray different from the first discharge tray is conveyed along the second sheet conveyance path. The discharge tray different from the first discharge tray is, for example, a bin tray.

The present disclosure is advantageous in, for example, the field of image forming apparatuses.

What is claimed is:

1. An image forming apparatus comprising:

a conveying device that conveys a sheet;

a detecting member that detects presence or absence of the sheet;

an image forming unit that forms an image on the sheet;

a first discharge tray to which the sheet having an image formed by the image forming unit is discharged;

a fan that sucks air around the first discharge tray; and an airflow unit that has an airflow path through which the air sucked by the fan flows, wherein the detecting member, by switching a posture thereof between a first posture and a second posture, detects the presence or absence of the sheet and changes a structure of the airflow path of the airflow unit.

2. The image forming apparatus according to claim 1, wherein the airflow path includes a first airflow path and a second airflow path different from the first airflow path, the detecting member includes an airflow valve part and a contact surface, the posture of the detecting member is switched from the first posture to the second posture when the sheet is brought into contact with the contact surface, and the airflow valve part closes the second airflow path when the posture of the detecting member is the first posture and opens the second airflow path when the posture of the detecting member is the second posture.

3. The image forming apparatus according to claim 2, wherein the conveying device includes a guide member that forms a conveyance path along which the sheet is conveyed, the guide member includes an opening that forms the second airflow path, and the contact surface protrudes to the conveyance path through the opening.

4. The image forming apparatus according to claim 3, wherein the contact surface extends across the conveyance path when the detecting member is in the first posture.

5. The image forming apparatus according to claim 3, wherein the detecting member further includes a rotation shaft, the airflow valve part and the contact surface rotate together around the rotation shaft when the sheet is brought into contact with the contact surface, and the posture of the detecting member is switched between the first posture and the second posture in accordance with rotation of the airflow valve part and the contact surface around the rotation shaft.

6. The image forming apparatus according to claim 3, wherein the detecting member further includes an adhesive member that is in close contact with the guide member when the detecting member is in the first posture.

7. The image forming apparatus according to claim 3, wherein the image forming unit includes a heating member that heats the sheet, and the sheet heated by the heating member is conveyed along the conveyance path.

8. The image forming apparatus according to claim 7, wherein the sheet is cooled with air flowing through the second airflow path.

9. The image forming apparatus according to claim 3, further comprising a second discharge tray that is different from the first discharge tray, wherein the sheet to be discharged to the second discharge tray is conveyed along the conveyance path.

10. The image forming apparatus according to claim 9, further comprising an optional device, wherein the second discharge tray is provided in the optional device.

11. The image forming apparatus according to claim 2, wherein the conveying device includes a rotatable roller, and the airflow valve part covers part of the roller.

12. The image forming apparatus according to claim 1, wherein the detecting member is provided in plurality along a direction intersecting a conveying direction in which the sheet is conveyed.

13. An image forming apparatus comprising:

a conveying device that conveys a sheet;

a detecting member that detects presence or absence of the sheet;

an image forming unit that forms an image on the sheet;

a first discharge tray to which the sheet having an image formed by the image forming unit is discharged;

a fan that sucks air around the first discharge tray; and an airflow unit that forms an airflow path through which the air sucked by the fan flows, wherein the detecting member detects the presence or absence of the sheet by switching a posture thereof between a first posture and a second posture, the airflow path changes when the posture of the detecting member is switched, the airflow path includes a first airflow path and a second airflow path different from the first airflow path, the detecting member includes an airflow valve part and a contact surface, the posture of the detecting member is switched from the first posture to the second posture when the sheet is brought into contact with the contact surface, and the airflow valve part closes the second airflow path when the posture of the detecting member is the first posture and opens the second airflow path when the posture of the detecting member is the second posture.

* * * * *